US009567881B2

(12) United States Patent
Brune

(10) Patent No.: US 9,567,881 B2
(45) Date of Patent: Feb. 14, 2017

(54) VALVETRAIN ASSEMBLY

(71) Applicant: GT Technologies, Westland, MI (US)

(72) Inventor: John Edmund Brune, Stockbridge, MI (US)

(73) Assignee: GT TECHNOLOGIES, Westland, MI (US)

( * ) Notice: Subject to any disclaimer, the term of this patent is extended or adjusted under 35 U.S.C. 154(b) by 0 days.

(21) Appl. No.: 14/843,287

(22) Filed: Sep. 2, 2015

(65) Prior Publication Data

US 2016/0061072 A1 Mar. 3, 2016

Related U.S. Application Data

(60) Provisional application No. 62/045,276, filed on Sep. 3, 2014.

(51) Int. Cl.

| | |
|---|---|
| ***F01L 1/18*** | (2006.01) |
| ***F01M 11/02*** | (2006.01) |
| ***F01L 1/14*** | (2006.01) |
| ***F01M 9/10*** | (2006.01) |
| *F01M 1/06* | (2006.01) |

(52) U.S. Cl.

CPC ..... *F01M 11/02* (2013.01); *F01L 1/14* (2013.01); *F01L 1/146* (2013.01); *F01L 1/18* (2013.01); *F01L 1/181* (2013.01); *F01M 9/10* (2013.01); *F01M 9/104* (2013.01); *F01M 9/107* (2013.01); *F01M 2001/064* (2013.01)

(58) Field of Classification Search

CPC ..... F01L 1/18; F01L 1/146; F01L 1/181; F01M 9/107; F01M 11/02; F01M 2001/064

USPC ..... 123/90.12, 90.27, 90.39, 90.44

See application file for complete search history.

(56) References Cited

U.S. PATENT DOCUMENTS 1,617,986 A 2/1927 Blank
1,624,497 A 4/1927 McAllister
(Continued)

FOREIGN PATENT DOCUMENTS

CN 201679532 U 12/2010
CN 201858036 U 6/2011
(Continued)

OTHER PUBLICATIONS

Communication dated Jan. 22, 2016 enclosing the Extended European Search Report dated Jan. 15, 2016 for European Application No. 15183665.7.

*Primary Examiner* — Ching Chang
(74) *Attorney, Agent, or Firm* — Howard & Howard Attorneys PLLC

(57) ABSTRACT

A valvetrain for translating force and oil between a valve and intermediate member of an engine, including a rocker, a shaft, and a recess. The rocker has an inner surface, a pad for engaging the valve, a socket for engaging the intermediate member, a socket port defined in the surface, and a socket channel extending from the socket port to the socket. The shaft has a bearing surface for supporting the rocker, a channel spaced from the bearing surface, a feed port in the bearing surface, and a feed channel extending from the feed port to the channel. The rocker rotates between: closed, with the socket port and feed port aligned; and open, with the socket port spaced from the feed port. A recess is disposed in the bearing surface adjacent to the feed port and extends to a base aligned with the socket port when the rocker is open.

10 Claims, 18 Drawing Sheets

(56) References Cited

U.S. PATENT DOCUMENTS

| | | | | |
|---|---|---|---|---|
| 2,563,699 | A | 8/1951 | Winter, Jr. | |
| 4,497,307 | A | 2/1985 | Paar et al. | |
| 7,293,539 | B2 * | 11/2007 | Hayward ..... | F01L 1/182 123/90.39 |
| 2005/0211206 | A1 | 9/2005 | Ruggiero et al. | |
| 2010/0242878 | A1 | 9/2010 | Maekawa | |
| 2016/0061062 | A1 | 3/2016 | Brune | |

FOREIGN PATENT DOCUMENTS

| | | | |
|---|---|---|---|
| GB | 928585 | A | 6/1963 |
| JP | 6088809 | A | 5/1985 |
| WO | 2009084598 | A1 | 7/2009 |
| WO | 2013020358 | A1 | 2/2013 |

* cited by examiner

VALVETRAIN ASSEMBLY

CROSS-REFERENCE TO RELATED APPLICATIONS

The present application which claims priority to and all the benefits of U.S. Provisional Patent Application No. 62/045,276, filed on Sep. 3, 2014, which is hereby expressly incorporated herein by reference in its entirety.

BACKGROUND OF THE INVENTION

1. Field of Invention

The present invention relates, generally, to automotive engine systems and, more specifically, to a valvetrain assembly for engines.

2. Description of the Related Art

Conventional engine valvetrain systems known in the art typically include one or more camshafts in rotational communication with a crankshaft supported in a block, one or more intake and exhaust valves supported in a cylinder head for regulating the flow of engine gasses, and one or more rocker arms for translating radial movement from the camshaft to linear movement of the valves. To that end, rocker arms are typically rotatably supported to a shaft which, in turn, is operatively attached to the cylinder head, thereby allowing the rocker arm to pivot about the shaft in response to rotation of the camshaft. The rocker arm typically includes a pad for engaging the valve, and a socket for engaging an intermediate member in communication with the camshaft. As the camshaft rotates, the intermediate member translates movement from the camshaft to the socket of the rocker arm, which pivots the rocker arm such that the pad subsequently translates force to the valve so as to open it. Thus, to effect rotation about the shaft and maintain proper engagement of the pad to the valve, and the socket to the intermediate member, the configuration of the rocker arm can be complicated in terms of geometry and packaging, particularly where the engine application necessitates a narrow-width cylinder head.

Because of the number of different engine types known in the art, the orientation and configuration of valvetrain systems typically varies with the engine application. One well known engine application known in the art, commonly referred to as a "cam-in-block" or "pushrod" engine, utilizes a valvetrain system that includes multiple rocker arms. As the convention suggests, in this application, the camshaft is rotatably supported in the engine block and the valves are supported above the camshaft. The intermediate member is typically a pushrod that engages the socket of the rocker arm at one end, and a hydraulic lash adjuster in communication with the camshaft at another end. In some applications, oil is translated along the intermediate member, such as through the pushrod, along a path going either to or from the rocker arm so as to lubricate and ensure proper rotation about the shaft.

Each of the components of an engine valvetrain system of the type described above must cooperate to effectively translate movement from the camshaft so as to operate the valves. In addition, each of the components must be designed not only to facilitate improved performance and efficiency, but also so as to reduce the cost and complexity of manufacturing and assembling the valvetrain system. While rocker arm assemblies and engine valvetrain systems known in the related art have generally performed well for their intended purpose, there remains a need in the art for a rocker arm assembly that has superior operational characteristics, and, at the same time, reduces the cost and complexity of manufacturing the components of the system, as well as the overall packaging size of the engine.

SUMMARY OF THE INVENTION

The present invention overcomes the disadvantages in the related art in a valvetrain assembly for translating force between an intermediate member in communication with a camshaft of an internal combustion engine and a valve supported in a cylinder head of the engine, and for translating lubrication from an oil pump of the engine to the intermediate member and the valve of the engine. The valvetrain assembly includes at least one rocker arm assembly and at least one elongated shaft. The rocker arm assembly has a substantially cylindrical inner surface, a pad spaced from the inner surface for engaging the valve of the engine, a socket spaced from the pad for engaging the intermediate member of the engine, a socket port defined in the inner surface, and a socket channel extending from the socket port to the socket. The shaft has an outer bearing surface for supporting the inner surface of the rocker arm assembly, an inner channel spaced from the outer bearing surface and in fluid communication with the oil pump of the engine, a feed port defined in the outer bearing surface, and a feed channel extending from the feed port to the inner channel. The rocker arm assembly is rotatable about the shaft between: a valve closed position, wherein the socket port of the rocker arm assembly is substantially aligned with the feed port of the shaft, and a valve open position, wherein the socket port of the rocker arm assembly is spaced from the feed port of the shaft. The valvetrain assembly further including a recess disposed in the outer bearing surface of the shaft adjacent to the feed port, the recess having an elongated profile extending from the feed port to a base, the base being substantially aligned with the socket port of the rocker arm assembly when the rocker arm assembly rotates to the valve open position.

The present invention is also directed toward a valvetrain assembly for translating force between an intermediate member in communication with a camshaft of an internal combustion engine and a valve supported in a cylinder head of the engine, and for translating lubrication from an oil pump of the engine to the intermediate member and the valve of the engine. The valvetrain assembly includes at least one rocker arm assembly and at least one elongated shaft. The rocker arm assembly has a substantially cylindrical inner surface, a pad spaced from the inner surface for engaging the valve of the engine, a socket spaced from the pad for engaging the intermediate member of the engine, a socket port defined in the inner surface, and a socket channel extending from the socket port to the socket. The shaft has an outer bearing surface for supporting the inner surface of the rocker arm assembly, an inner channel spaced from the outer bearing surface and in fluid communication with the oil pump of the engine, a feed port defined in the outer bearing surface, and a feed channel extending from the feed port to the inner channel. The rocker arm assembly is rotatable about the shaft between: a valve closed position, wherein the socket port of the rocker arm assembly is substantially aligned with the feed port of the shaft, and a valve open position, wherein the socket port of the rocker arm assembly is spaced from the feed port of the shaft. The valvetrain assembly further including a recess disposed in the inner surface of the rocker arm assembly adjacent to the socket port, the recess having an elongated profile extending from the socket port to a base, the base being substantially aligned with the feed port of the shaft when the rocker arm assembly rotates to the valve open position.

In this way, the present invention significantly reduces the complexity and packaging size of the valvetrain assembly and its associated components. Moreover, the present invention reduces the cost of manufacturing valvetrain assemblies that have superior operational characteristics, such as improved engine performance, control, lubrication, efficiency, as well as reduced vibration, noise generation, and packaging size.

BRIEF DESCRIPTION OF THE DRAWINGS

Other objects, features, and advantages of the present invention will be readily appreciated as the same becomes better understood after reading the subsequent description taken in connection with the accompanying drawing wherein.

DETAILED DESCRIPTION OF THE INVENTION

Figure 1:
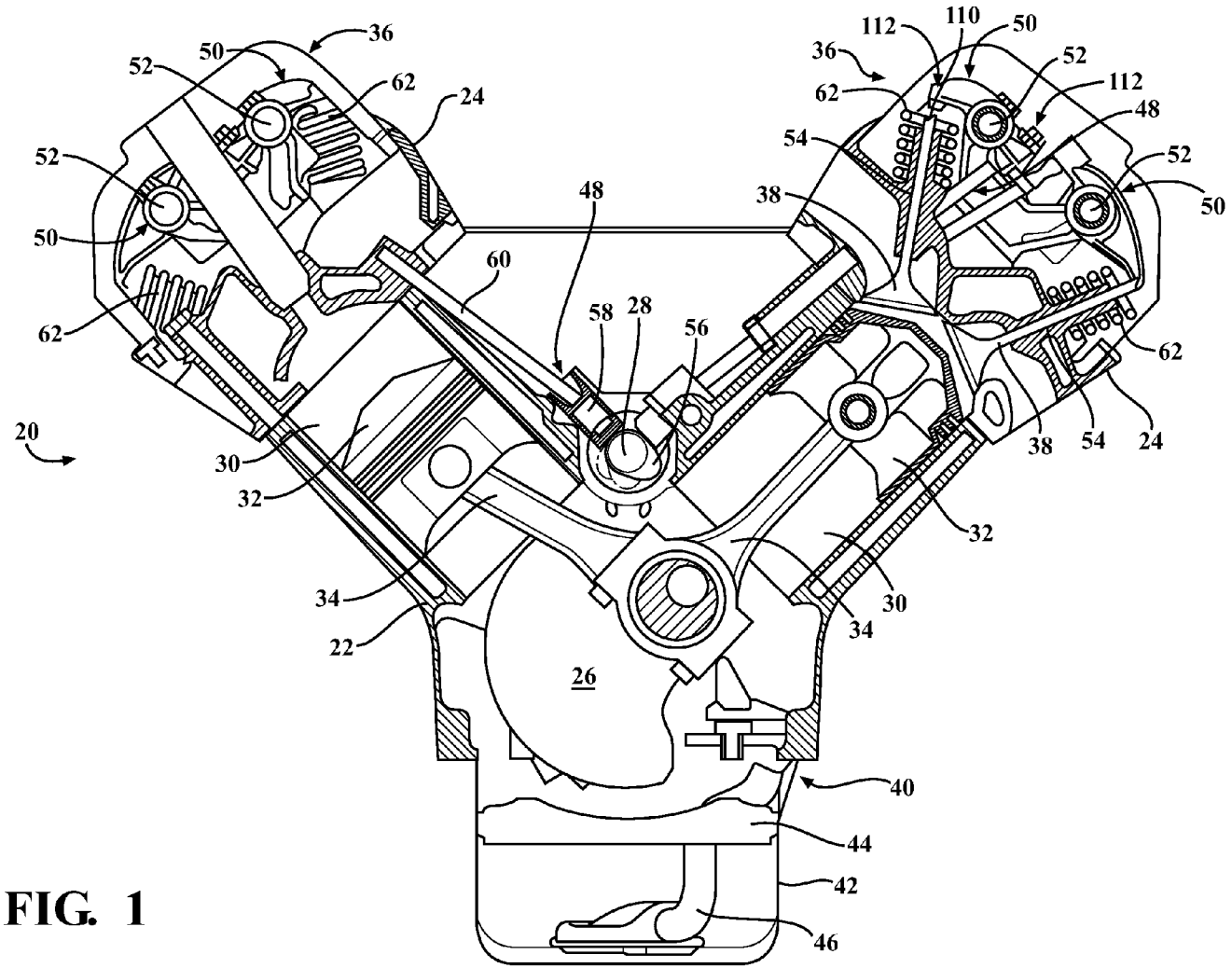
FIG. 1 is a partial front sectional view of an automotive engine showing a camshaft mounted in a block and a pair of cylinder heads.

Referring now to the drawings, where like numerals are used to designate like structure, a portion of an internal combustion engine is illustrated at 20 in FIG. 1. The engine 20 includes a block 22 and one or more cylinder heads 24 mounted to the block 22. A crankshaft 26 is rotatably supported in the block 22, and a single camshaft 28 is rotatably supported in the block 22 spaced from the crankshaft 26. The crankshaft 26 drives the camshaft 28 via a timing chain or belt (not shown, but generally known in the art). The block 22 typically includes one or more cylinders 30 in which a piston 32 is supported and travels along. The piston 32 is pivotally connected to a connecting rod 34, which is also connected to the crankshaft 26.

In operation, combustion in the cylinders 30 of the engine 20 generates rotational torque which is subsequently translated by the crankshaft 26 to the camshaft 28 which, in turn, cooperates with a valvetrain assembly, generally indicated at 36, to control the flow and timing of intake and exhaust gasses between the cylinder heads 24, and the cylinders 30, and the outside environment. Specifically, the camshaft 28 controls what is commonly referred to in the art as "valve events," whereby the camshaft 28 effectively actuates valves 38 supported in the cylinder head 24 at specific time intervals with respect to the rotational position of the crankshaft 26, so as to effect a complete thermodynamic cycle of the engine 20.

While the engine 20 illustrated in FIG. 1 is a V-configured, cam-in-block, overhead-valve, pushrod-actuated, spark-ignition Otto-cycle engine, those having ordinary skill in the art will appreciate that the engine 20 could be of any suitable configuration, with any suitable number of camshafts 28 disposed in any suitable way, controlled using any suitable thermodynamic cycle, and with any suitable type of valvetrain 36, without departing from the scope of the present invention. Further, while the valvetrain assembly 36 of the engine 20 is configured for use with automotive passenger vehicles, those having ordinary skill in the art will appreciate that the present invention could be used in any suitable application without departing from the scope of the present invention. By way of non-limiting example, the present invention could be used in connection with passenger or commercial vehicles, motorcycles, all-terrain vehicles, lawn care equipment, heavy-duty trucks, trains, airplanes, ships, construction vehicles and equipment, military vehicles, or any other suitable application without departing from the scope of the present invention.

As shown in FIG. 1, the engine 20 also includes a lubrication system 40 used to translate oil from an oil pan 42 mounted to the block 22 adjacent to the crankshaft 26. To that end, the lubrication system 40 typically includes a mechanically-driven oil pump 44 mounted to an end of the crankshaft 26. However, those having ordinary skill in the art will appreciate that the oil pump 44 could be configured or otherwise driven differently. The oil pump 44 is in fluid communication with a pickup tube 46 disposed in the oil pan 42, and translates oil from the oil pan 42 via the pickup tube 46 to various parts of the engine 20 requiring lubrication, such as the crankshaft 26, camshaft 28, and valvetrain assembly 36.

Figure 3:
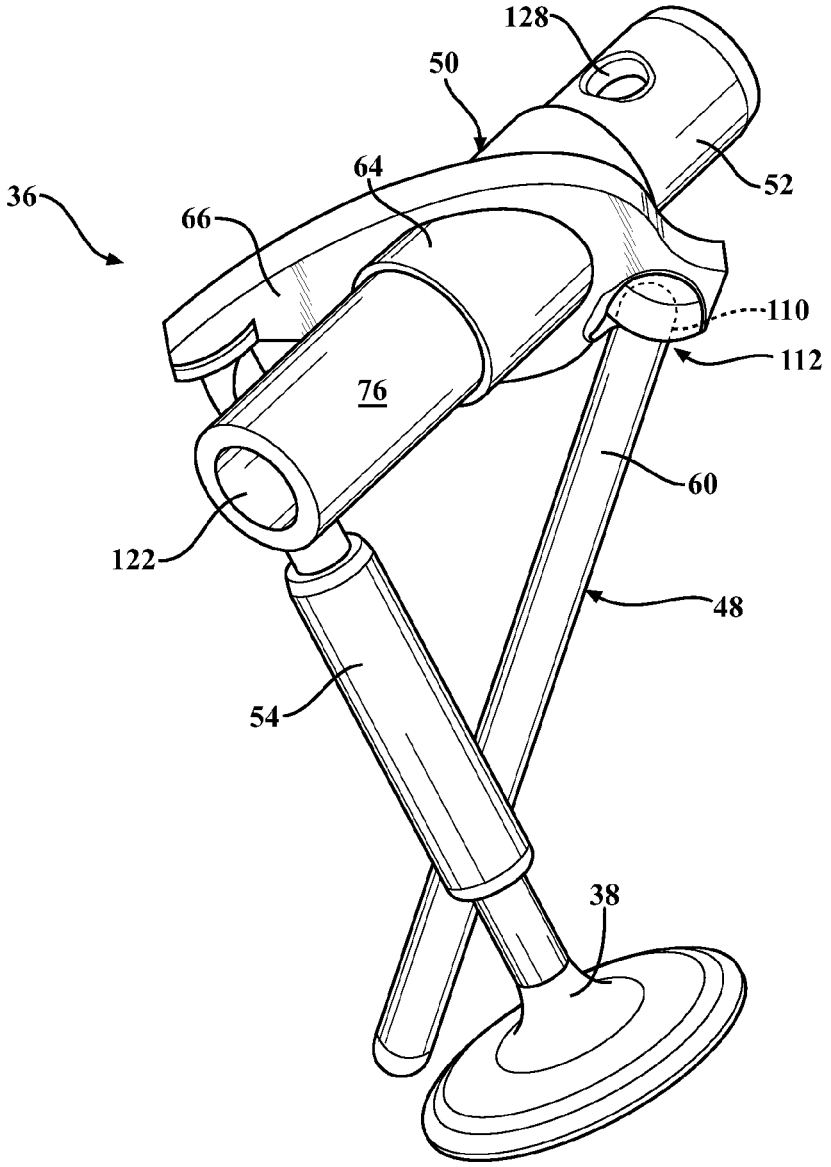
FIG. 3 is a partial perspective view of the valve, valve guide, pushrod, shaft, and rocker arm assembly of FIG. 2.

As shown best in FIGS. 1 and 3, the camshaft 28 cooperates with the valvetrain assembly 36 so as to translate radial movement from the camshaft 28 into linear movement of the valves 38 to control the valve events, as discussed above. More specifically, the valvetrain assembly 36 is used to translate force between one or more intermediate members, generally indicated at 48, and the valves 38. To that end, the valvetrain assembly 36 includes a rocker arm assembly 50 in communication with the valves 38 and intermediate member 48. In addition, in one embodiment, the valvetrain assembly 36 is also used to translate lubrication from the oil pump 44 to the intermediate member 48 and valves 38. To that end, the valvetrain assembly 36 also includes an elongated shaft 52 for supporting the rocker arm assembly 50. Both the rocker arm assembly 50 and the shaft 52 will be described in greater detail below.

As noted above, the arm assembly 50 is used to translate force between the intermediate member 48 in communication with the camshaft 28 and the valve 38 supported in the cylinder head 24. The valve 38 is supported by a valve guide 54 operatively attached to the cylinder head 24. The valve guide 54 allows the valve 38 to travel with respect to the cylinder head 24 in response to rotation of the camshaft 28. To that end, the camshaft 28 includes a plurality of what are typically egg-shaped lobes 56 having a high point 56A and a low point 56B (see FIG. 13). The lobes 56 are in contact with the intermediate member 48 which, in turn, translates radial movement from the camshaft 28 to the rocker arm assembly 50. The interaction of the lobes 56 of the camshaft 28, intermediate member 48, and rocker arm assembly 50 will be described in greater detail below.

Figure 13:
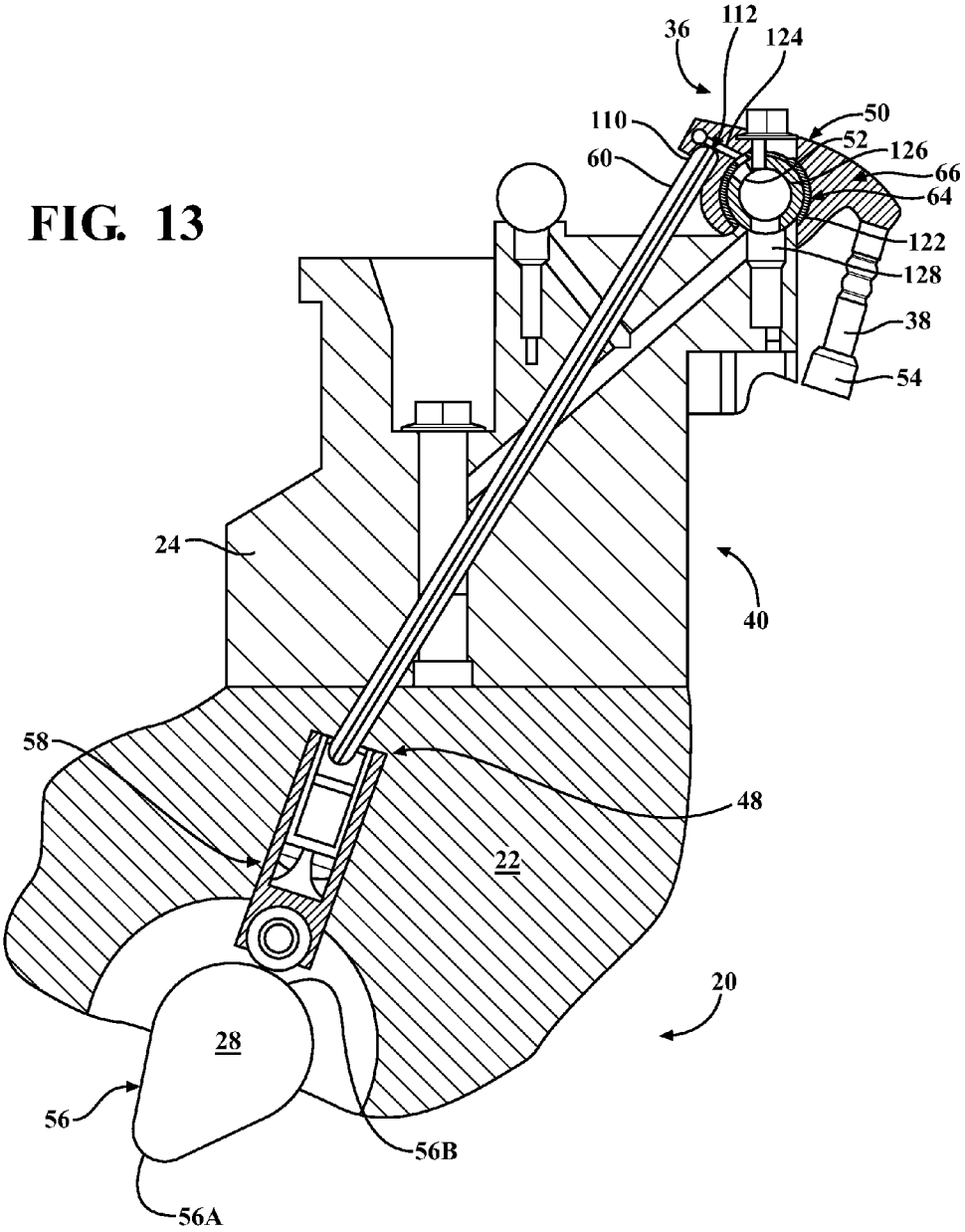
FIG. 13 is an enlarged partial sectional view of the cylinder head and valvetrain system of FIGS. 1 and 2, showing oil flow paths.

As shown in FIGS. 1 and 13, the intermediate member 48 may include a hydraulic lash adjuster 58 as well as a pushrod 60 (not shown in detail, but generally known in the art). Typically, the hydraulic lash adjuster 58 engages the lobe 56 of the camshaft 28, while the pushrod 60 is disposed between and engages both the hydraulic lash adjuster 58 and the rocker arm assembly 50. However, those having ordinary skill in the art will appreciate that the intermediate member 48 could be configured in any way suitable to translate force between the camshaft 28 and rocker arm assembly 50, with or without utilizing a discreet pushrod 60 or hydraulic lash adjuster 58, without departing from the scope of the present invention. When the camshaft 28 rotates such that the high point 56A of the lobe 56 engages the hydraulic lash adjuster 58, the pushrod 60 presses against the rocker arm assembly 50 which, in turn, pushes the valve 38 open. Thus, the egg-shaped profile of the lobes 56 of the camshaft 28 effectively displaces the valve 38. As will be appreciated from the subsequent description of the rocker arm assembly 50, the displacement caused by the profile of the lobes 56 of the camshaft 28 can be effectively multiplied so as to displace the valve 38 further along the valve guide 54.

After the valve 38 has been opened in response to the rotational position of the camshaft 28 lobe, the valve 38 subsequently closes again, following the profile of the lobe 58. To that end, a compression spring 62 is typically disposed around the valve guide 54, supported in the cylinder head 24, and operatively attached to the valve 38 (see FIG. 1). Thus, as the valve 38 opens, the spring 62 compresses against the cylinder head 24 and stores potential energy. As the camshaft 28 continues to rotate, and as the high point 56A of the lobe moves away and the low point 56B engages the hydraulic lash adjuster 58, the potential energy stored in the spring 62 is released, thereby closing the valve 38 in response.

Figure 8:
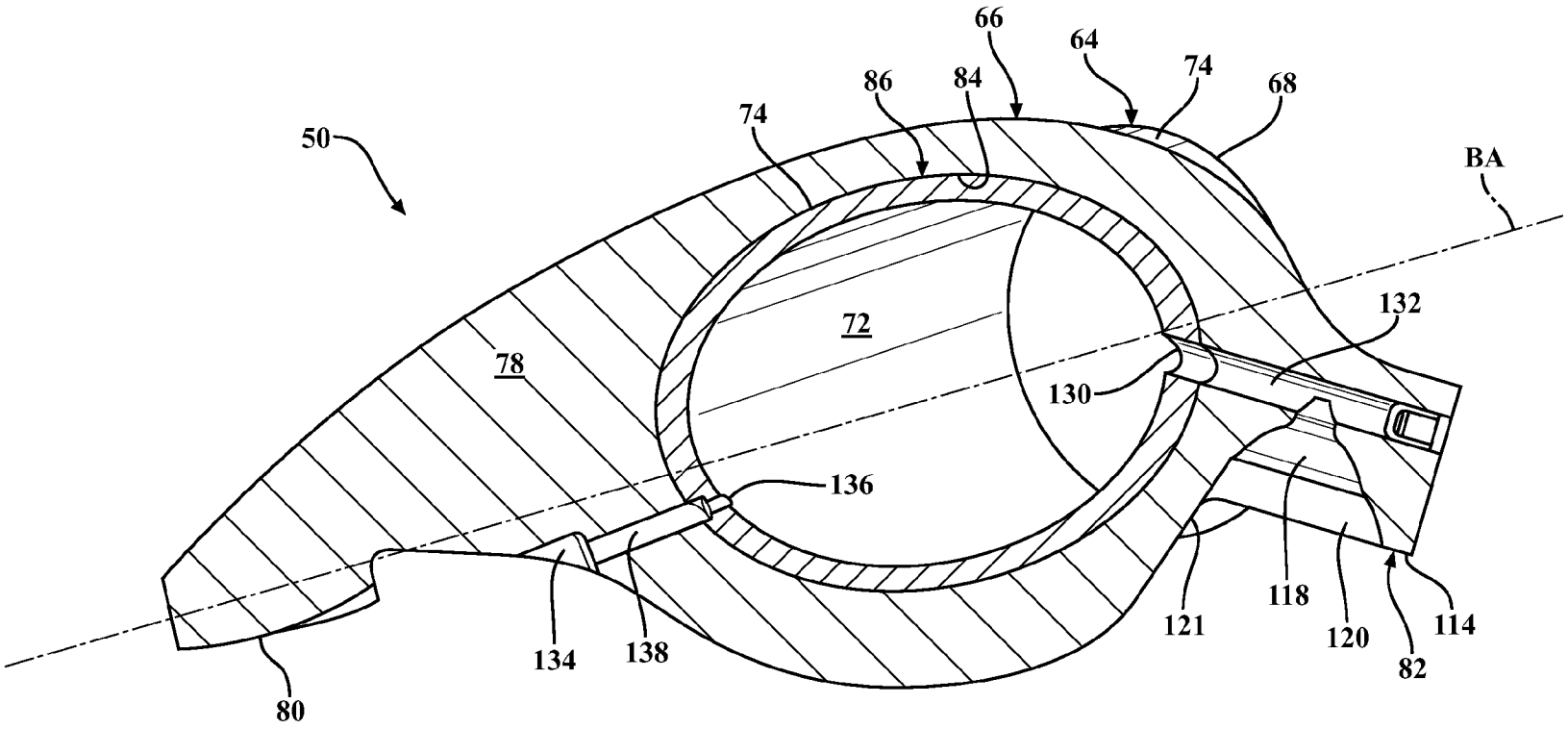
FIG. 8 is a sectional view taken along line 8-8 of FIG. 6.
Figure 9:
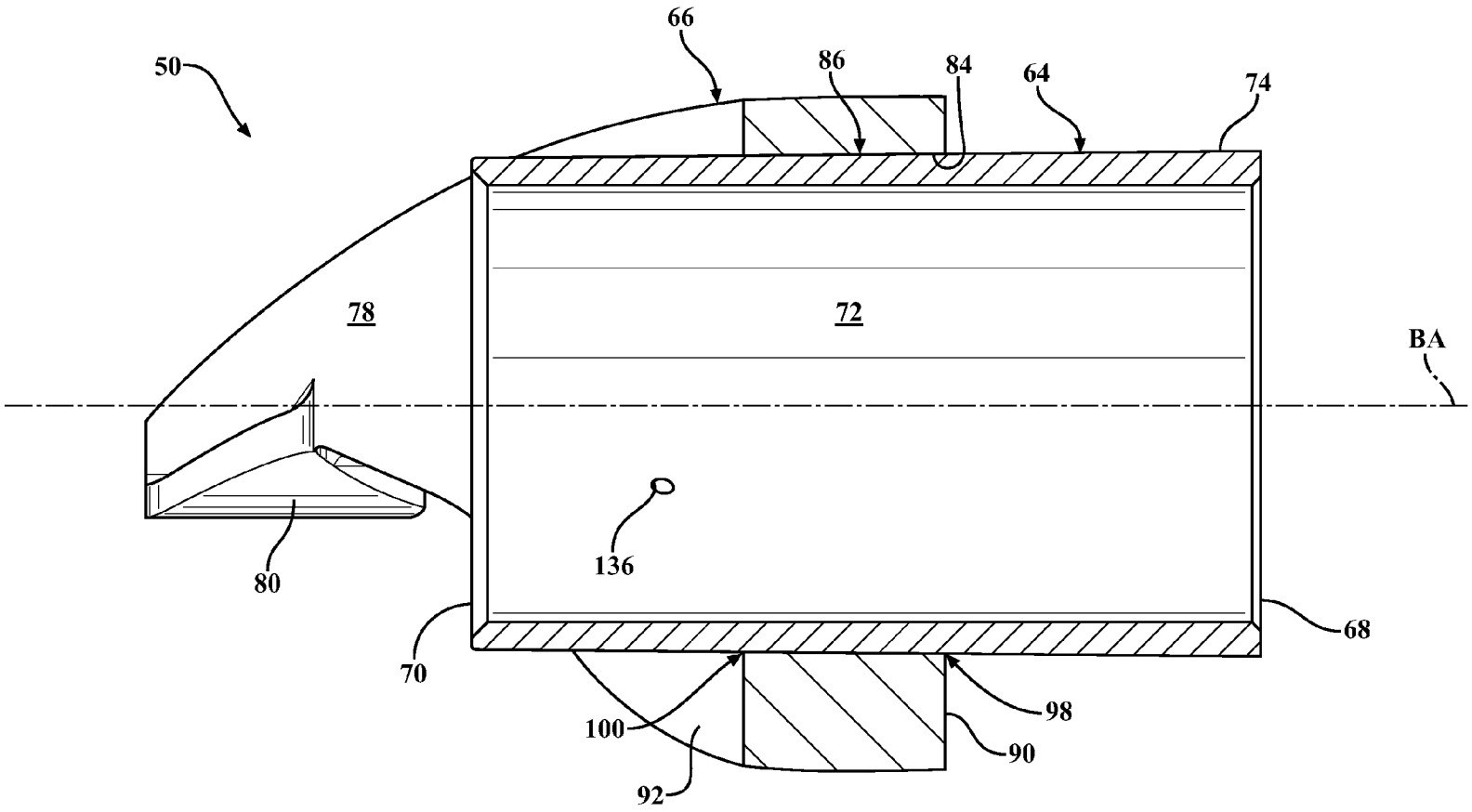
FIG. 9 is a sectional view taken along line 9-9 of FIG. 7.

Referring now to FIGS. 3-11, the rocker arm assembly 50 includes a tube member 64 and an arm 66. The tube member 64 has first and second ends 68, 70, a substantially cylindrical inner surface 72, and a tapered outer surface 74. The inner surface 72 of the tube member 64 is supported by an outer bearing surface 76 of the shaft 52 so as to allow the rocker arm assembly 50 to rotate about the shaft 52 in operation. As best shown in FIG. 9, in one embodiment, the inner surface 72 of the tube member 64 of the rocker arm assembly 50 has a substantially constant diameter between the first end 68 and the second end 70 of the tube member 64 so as to define a substantially congruent bearing surface along the length of the tube member 64. However, those having ordinary skill in the art will appreciate that the inner surface 72 of the tube member 64 could have any suitable profile without departing from the scope of the present invention. By way of non-limiting example, a stepped configuration is conceivable.

Figure 2:
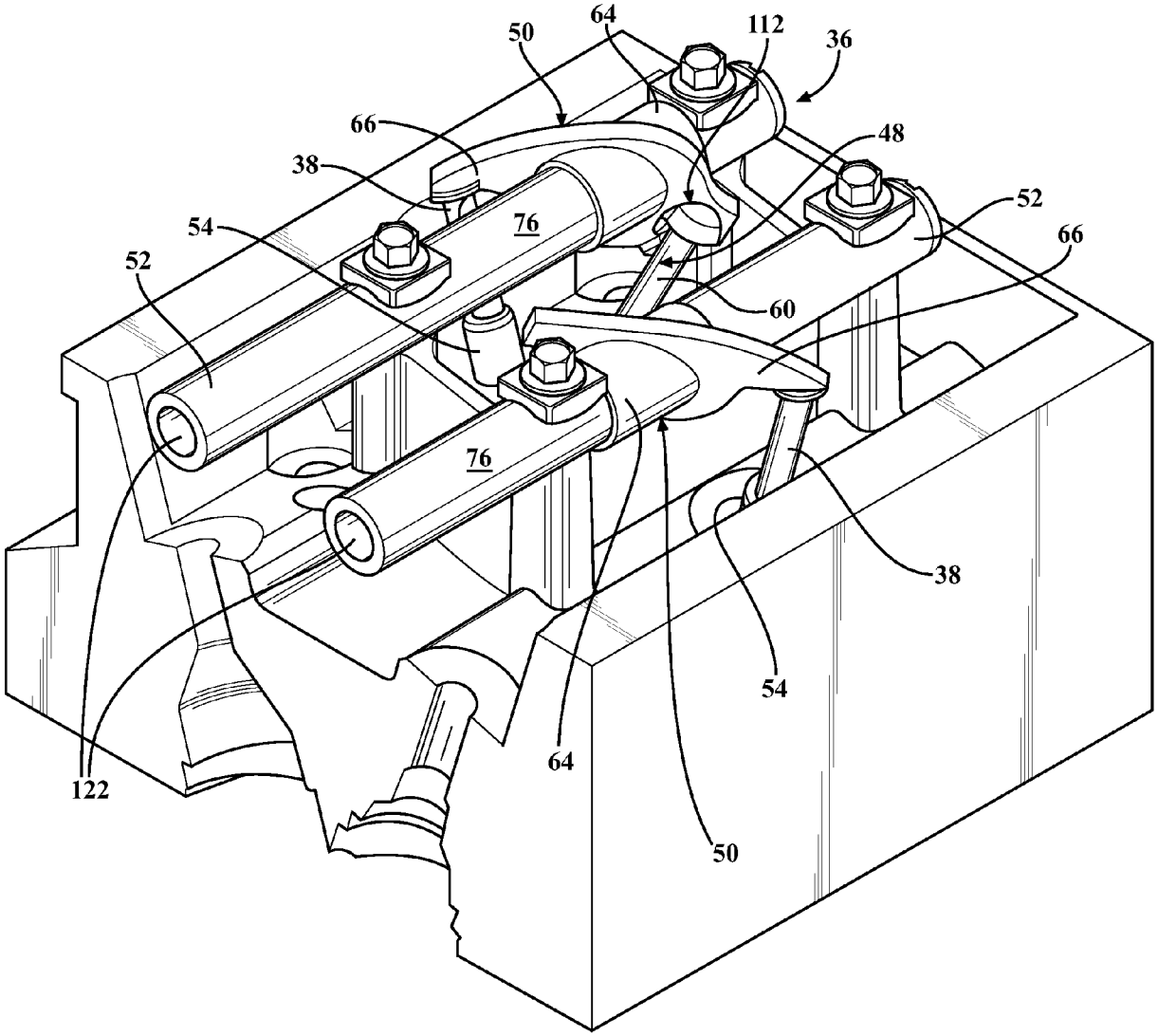
FIG. 2 is a partial perspective view of one of the cylinder heads of FIG. 1 showing a valvetrain system with a pair of shafts, valves, guides, pushrods, and rocker arm assemblies, according to one embodiment of the present invention.

The arm 66 of the rocker arm assembly 50 has a body 78 extending between a pad 80 and a socket 82. The pad 80 is used to engage and press against the valve 38 (see FIGS. 2 and 3). To that end, the pad 80 has a contoured profile configured so to remain substantially engaged to the valve 38 as the rocker arm assembly 50 rotates in operation. The socket 82 is used to engage the intermediate member 48 of the engine 20 (see FIG. 2). The body 78 of the arm 66 also has a tapered bore 84 disposed between the pad 80 and the socket 82 (see FIGS. 10 and 11). In one embodiment, the tapered bore 84 of the arm 66 cooperates with the tapered outer surface 74 of the tube member 64 so as to define a lock 86 for constraining the arm 66 to the tube member 64 at a predetermined position between the first end 68 and second end 70 (see FIGS. 8 and 9). The pad 80, socket 82, tapered bore 84, and lock 86 will be described in greater detail below.

Figure 10:
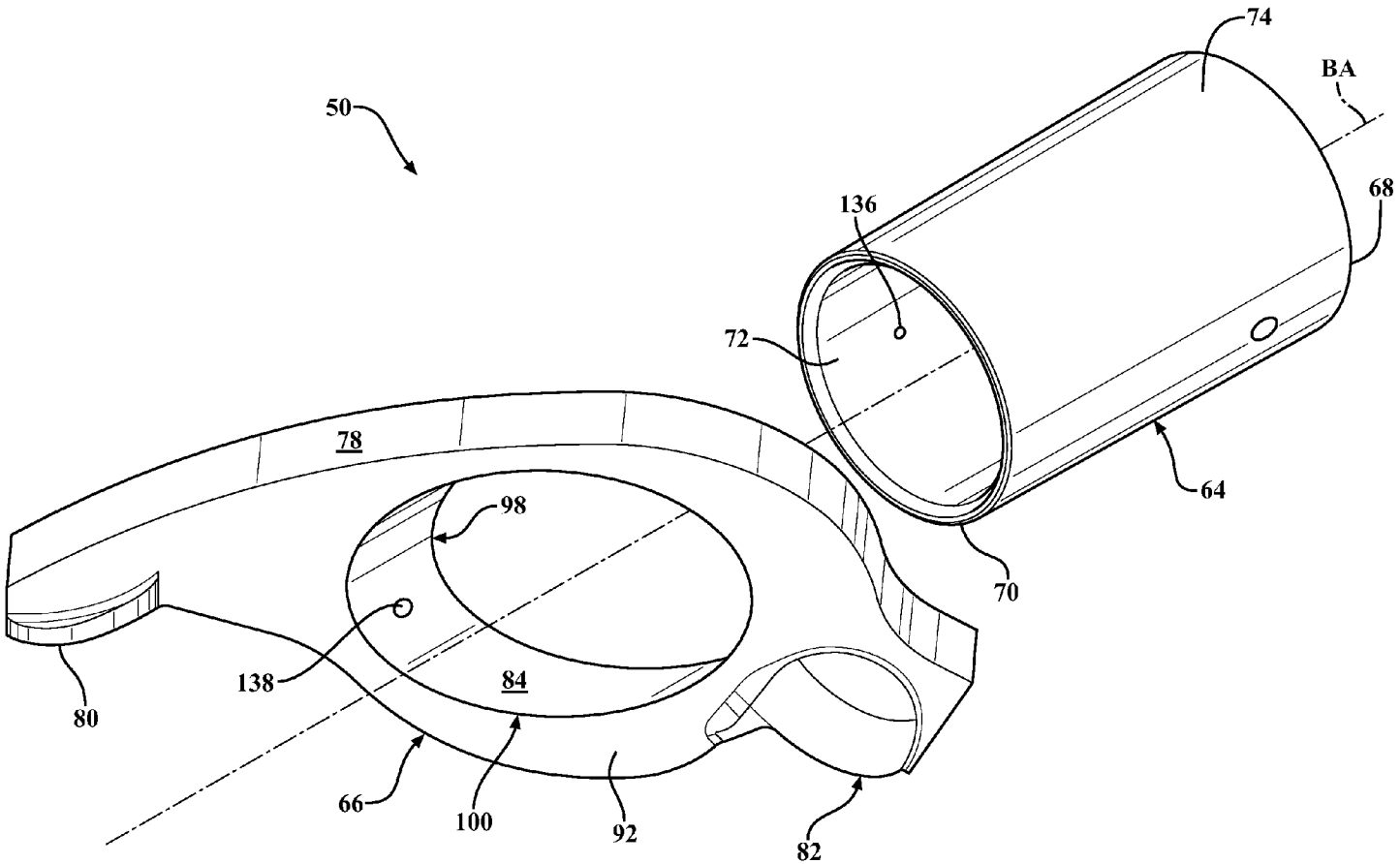
FIG. 10 is an exploded perspective view of the rocker arm assembly of FIG. 4, showing the tube member and the arm in an unassembled configuration.
Figure 11:
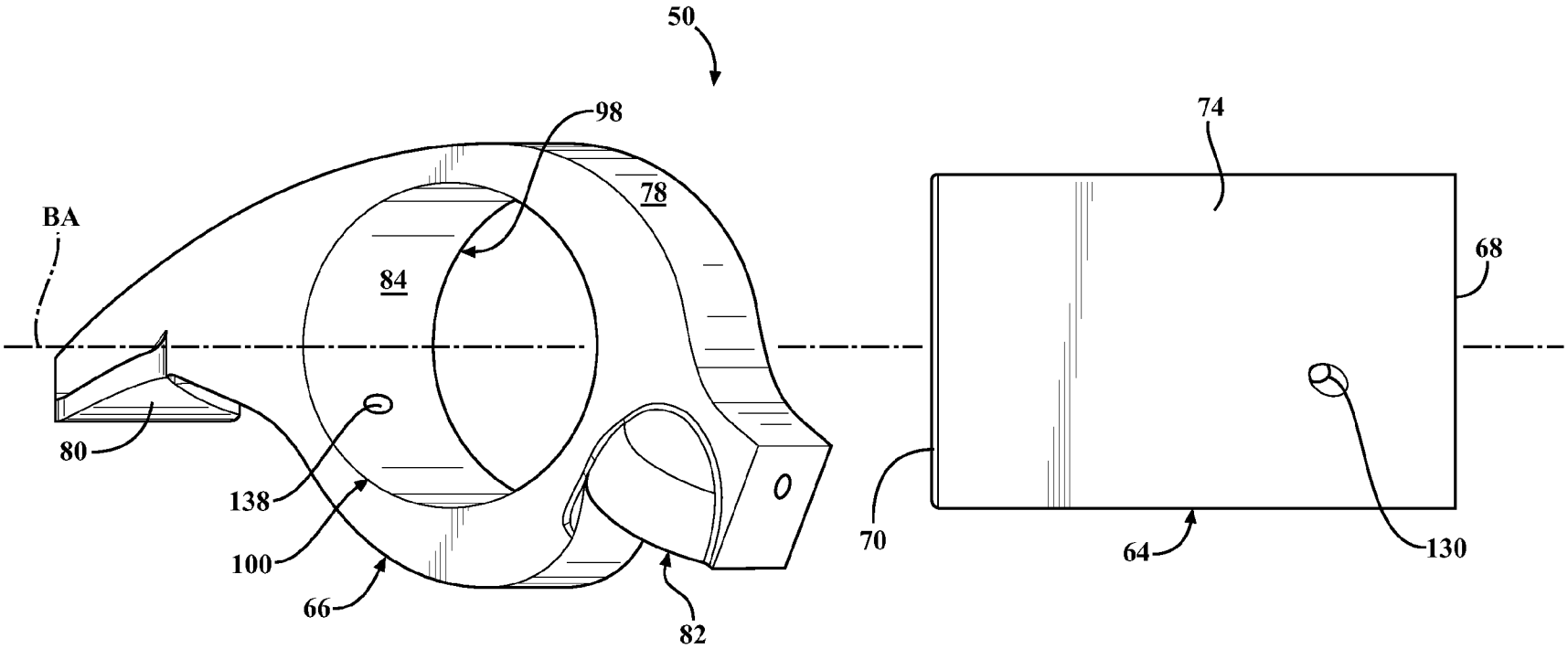
FIG. 11 is an exploded right side plan view of the rocker arm assembly of FIG. 10, showing the tube member and the arm in an unassembled configuration.

As shown in FIGS. 10 and 11, the tube member 64 and the arm 66 of the rocker arm assembly 50 may be formed as separate components, whereby the lock 86 aligns and constrains the rocker arm assembly 50 for subsequent attachment. To that end, and in one embodiment, the rocker arm assembly 50 may include a joint, indicated generally at 88, that cooperates with the lock 86 so as to operatively attach the arm 66 to the tube member 64 (see FIGS. 4 and 5). It will be appreciated that the joint 88 could be formed, defined, or otherwise used in a number of different ways. By way of non-limiting example, if the tube member 64 and arm 66 are manufactured from steel and, the joint 88 could be a stake, a braze filler, or a weld pool, whereby the joint 88 is formed via a mechanical operation, a brazing operation, or a welding operation, respectively. Moreover, it will be appreciated that the tube member 64 and arm 66 could be manufactured from any suitable type of material, of the same or different materials or alloys thereof, without departing from the scope of the present invention. Further, it will be appreciated from the description of the interaction of the rocker arm assembly 50 and shaft 52 below that the valvetrain assembly 36 of the present invention could utilize a rocker arm assembly 50 without a discrete arm 66, tube member 64, or lock 86 as illustrated throughout the Figures, without departing from the scope of the present invention.

As noted above, the lock 86 of the rocker arm assembly 50 is defined by the cooperation between the tapered bore 84 of the arm 66 and the tapered outer surface 74 of the tube member 64. To that end, as shown best in FIGS. 7 and 9, the body 78 of arm 66 has opposing first and second sides 90, 92 with the tapered bore 84 extending from the first side 90 to the second side 92. The sides 90, 92 are generally flat and merge with the pad 80 and socket 82, whereby sides 90, 92 are spaced from each other at a substantially constant distance, defining the body 78 of the arm 66 with a substantially constant thickness between the pad 80 and socket 82. However, it will be appreciated that the sides 90, 92 could have any suitable configuration, congruent along the length of the arm 66 or otherwise, without departing from the scope of the present invention.

As noted above, depending on the specific engine 20 configuration, the valvetrain assembly 36 may include complex geometry and/or packaging so as to minimize the overall packaging size of the engine. Thus, those having ordinary skill in the art will appreciate that the shape and size of the cylinder heads 24 directly influences the size, configuration, and orientation of the rocker arm assembly 50. In particular, minimizing cylinder head 24 width is desirable for optimizing engine 20 packaging size. Thus, in reducing the width of the cylinder head 24, the rocker arm assembly 50 geometry typically becomes more complex. Specifically, the valve 38 and intermediate member 38 may not be equally spaced from the shaft 52 supporting the rocker arm assembly 50. Moreover, the valve 38 and intermediate member 38 may be angled with respect to one another or to the shaft 52 (see FIG. 3). Thus, the tapered bore 84 of the arm 66 may not be aligned perpendicularly with the sides 90, 92 of the arm 66. As such, in one embodiment, an imaginary longitudinal plane LP is defined between the first side 90 and the second side 92 of the arm 66, and a bore axis BA is defined along the tapered bore 84, whereby the bore axis BA intersects the longitudinal plane LP at an obtuse first angle 94 (see FIG. 6). The obtuse first angle 94 defines a supplementary second angle 96, whereby the sum of the angles 94, 96 is 180-degrees. Advantageously, and in one embodiment, the angles 94, 96 are each less than 135-degrees. However, it will be appreciated that the angles 94, 96 could be of any suitable value without departing from the scope of the present invention. For the purpose of clarity, and to give multi-dimensional reference to the relationships of the longitudinal plane LP and bore axis BA, an imaginary reference plane RP may be defined between the pad 80 and the socket 82 of the arm 66, essentially by the top plan view of FIG. 6, where the reference plane RP intersects the longitudinal plane LP perpendicularly, and the bore axis BA is substantially parallel to the reference plane RP.

Referring now to FIGS. 9-11, the tapered bore 84 of the arm 66 has a first perimeter 98 and a second perimeter 100, with the first perimeter 98 being larger than the second perimeter 100 so as to allow the tapered outer surface 74 of the tube member 64 to engage the tapered bore 84 and effect assembly of the arm 66 and tube member 64. In one embodiment, a ratio between the first perimeter and the second perimeter is less than 1.02:1, thereby optimizing the configuration of the arm 66 and tube member 64 so as to minimize the difficulty in manufacturing the tapered bore 84 of the arm 66 and the tapered outer surface 74 of the tube member 64, as well as to optimize the functionality of the lock 86, as described above. However, it will be appreciated that the perimeters 98, 100 could be configured in any suitable way without departing from the scope of the present invention.

Figure 4:
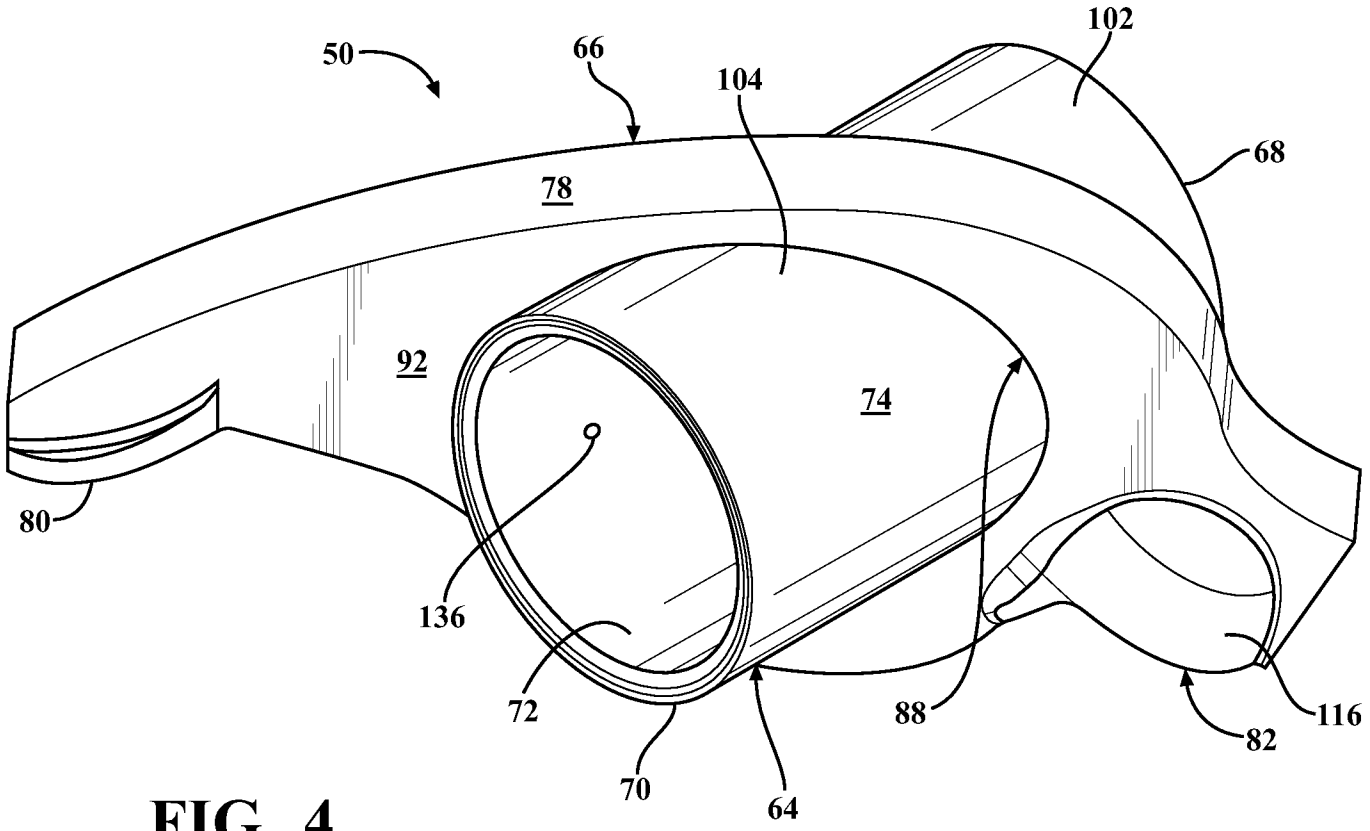
FIG. 4 is an enlarged perspective view of the rocker arm assembly of FIGS. 2 and 3, showing a tube member and an arm in an assembled configuration, according to one embodiment of the present invention.
Figure 5:
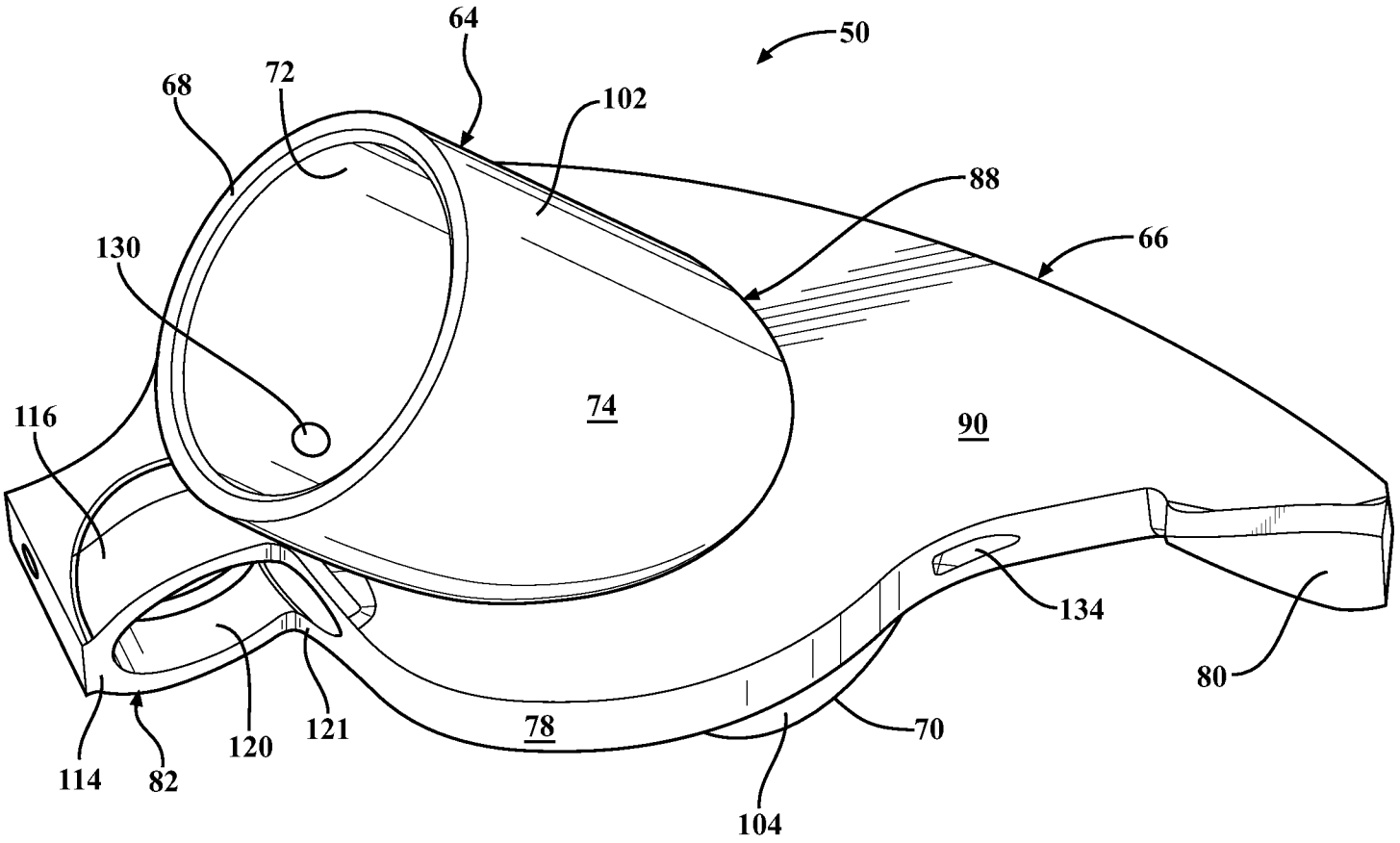
FIG. 5 is a rotated perspective view of the rocker arm assembly of FIGS. 2-4.
Figure 6:
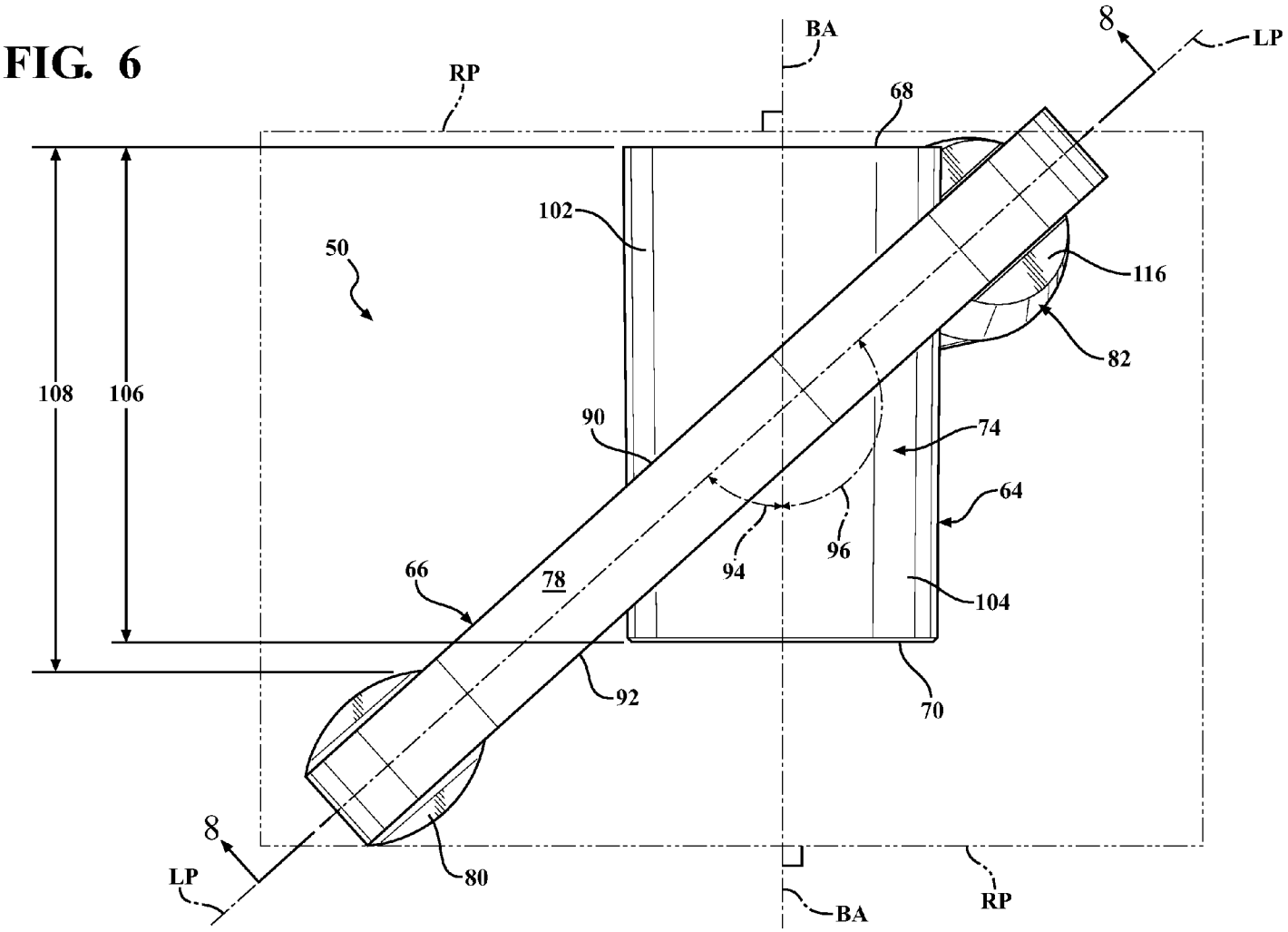
FIG. 6 is a top plan view of the rocker arm assembly of FIGS. 2-5.
Figure 7:
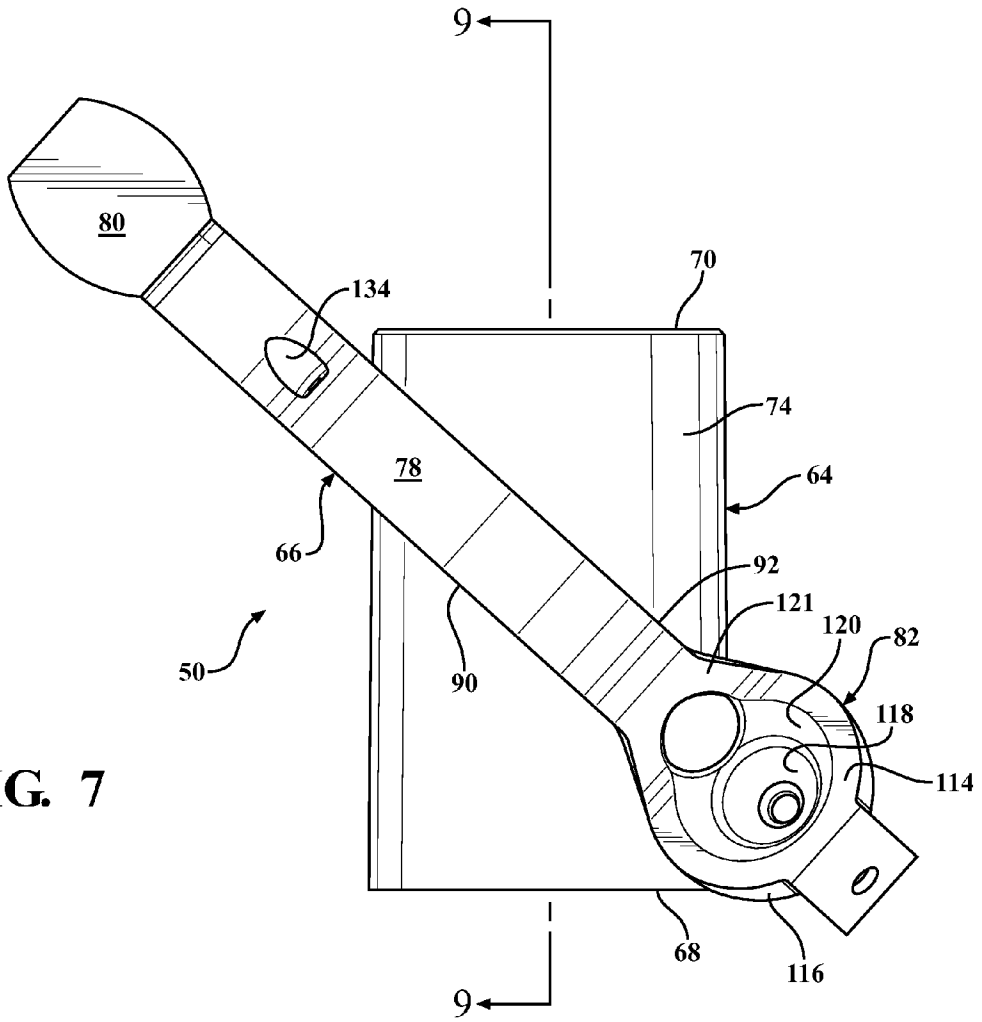
FIG. 7 is a bottom plan view of the rocker arm assembly of FIGS. 2-6.

As best shown in FIGS. 4-6, in one embodiment, a first area 102 of the tube member 64 is defined between the first side 90 of the body 78 of the arm 66 and the first end 68 of the tube member 64. Similarly a second area 104 of the tube member 64 is defined between the second side 92 of the body 78 of the arm 66 and the second end 68 of the tube member 64. The first area 102 is larger than the second area 104 so as to minimize the length of the tube member 64 and thickness of the arm 66, providing sufficient engagement between the tube member 64 and the arm 66, as well as to optimize the distribution of stress and load along the tube member 64 in operation.

In one embodiment, a first distance 106 is defined along the bore axis BA between the first end 68 of the tube member 64 and the second end 70 of the tube member 64. Similarly, a second distance 108 is defined along the bore axis BA between the first end 68 of the tube member 64 and the pad 80 of the arm 66 (see FIG. 6). The second distance 108 is greater than the first distance 106 so as to minimize the length of the tube member 64, thereby reducing the necessary packaging space required for the rocker arm assembly 50 in the cylinder head 24.

As noted above, the socket 82 of the arm 66 of the rocker arm assembly 50 is used to engage the intermediate member 48 of the engine 20. More specifically, the socket 82 engages a ball end 110 of the pushrod 60 (see FIGS. 1, 3, and 13) to define a pivoting connection, indicated generally at 112, which ensures engagement between the intermediate member 48 and the rocker arm assembly 50 at varying respective angles in operation. To that end, the socket 82 includes an upper flange surface 114, an outer socket surface 116, a receiving cup 118, and a clearance cup 120 (see FIGS. 7 and 8). The upper flange surface 114 is spaced from the first side 90 and the second side 92 of the body 78 of the arm 66. The outer socket surface 116 extends between and merges with the upper flange surface 114 and at least one of the first side 90 and the second side 92 of the body 78 of the arm 66. The receiving cup 118 is spaced from the flange surface 114 and is used to engage the intermediate member of the engine, such as the ball end 110 of the pushrod 60. Thus, the receiving cup 118 of the socket 82 cooperates with the ball end 110 of the pushrod 60 to define the pivoting connection 112 described above. The clearance cup 120, as the name suggests, contributes to an increased rage of motion of the pivoting connection 112 described above. The clearance cup 120 is disposed between and merges with the receiving cup 118 and the upper flange surface 114. It will be appreciated that the clearance cup 120 facilitates a smooth transition between the receiving cup 118 and the upper flange surface 114 so as to optimize distribution of applied stress occurring during operation of the valvetrain assembly 36 at a relatively high-stress location of the rocker arm assembly 50, while simultaneously affording optimized packing within the cylinder head 24.

In one embodiment, the socket 82 of the arm 66 further includes a transition portion 121 merging the body 78 of the arm 66 with at least a portion of the upper flange surface 114 (see FIG. 5), thereby providing the socket 82 with additional rigidity. Similarly, in one embodiment, the upper flange surface 114 of the socket 82 is spaced from the tube member 64 (see FIGS. 5 and 7), resulting in a congruent upper flange surface 114 with improved load capability and optimized stress concentration.

Figure 12:
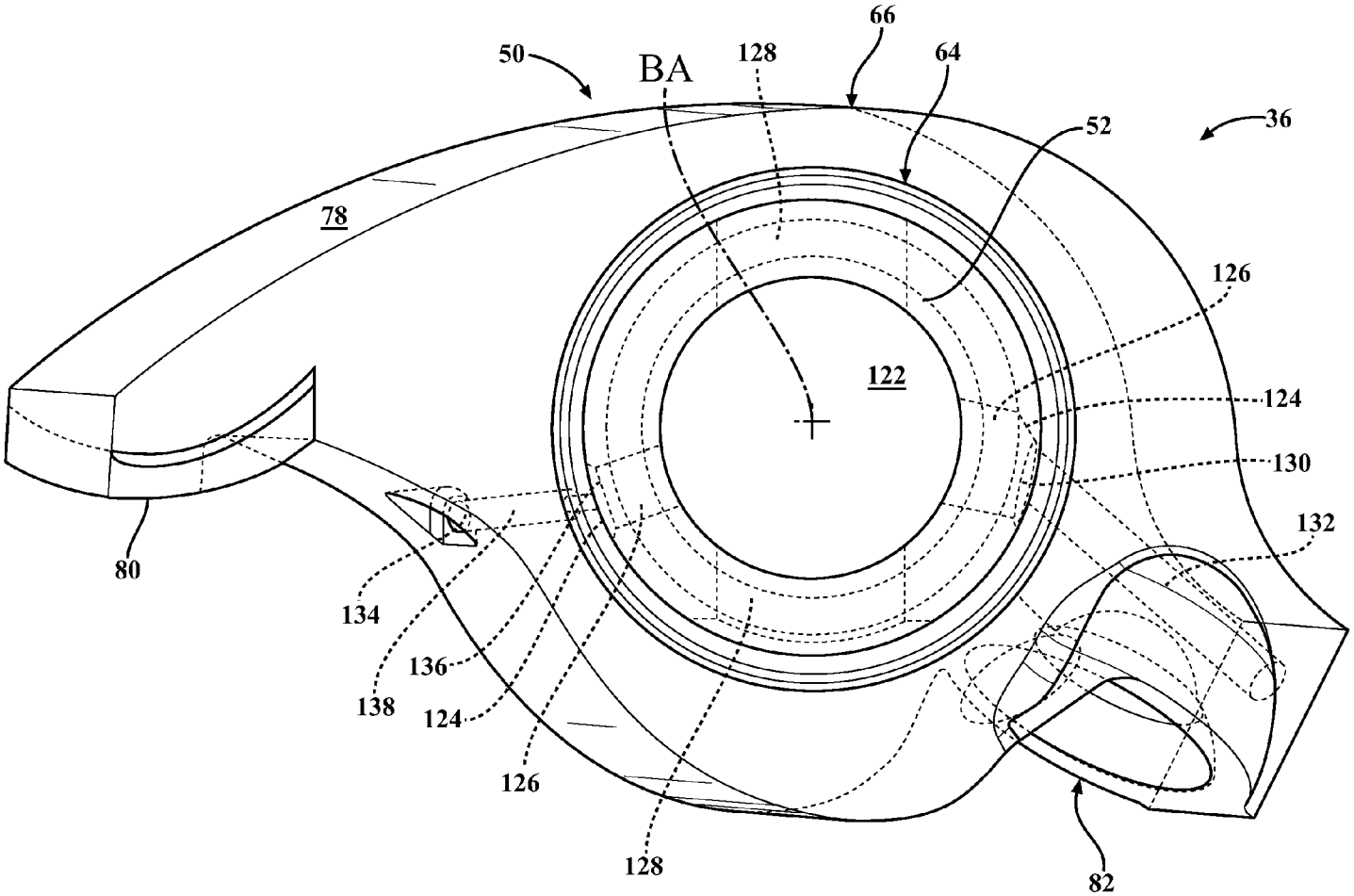
FIG. 12 is an enlarged front plan view of the rocker arm assembly and shaft of FIG. 2 with hidden lines visible, showing additional detail of oil flow paths.
Figure 17:
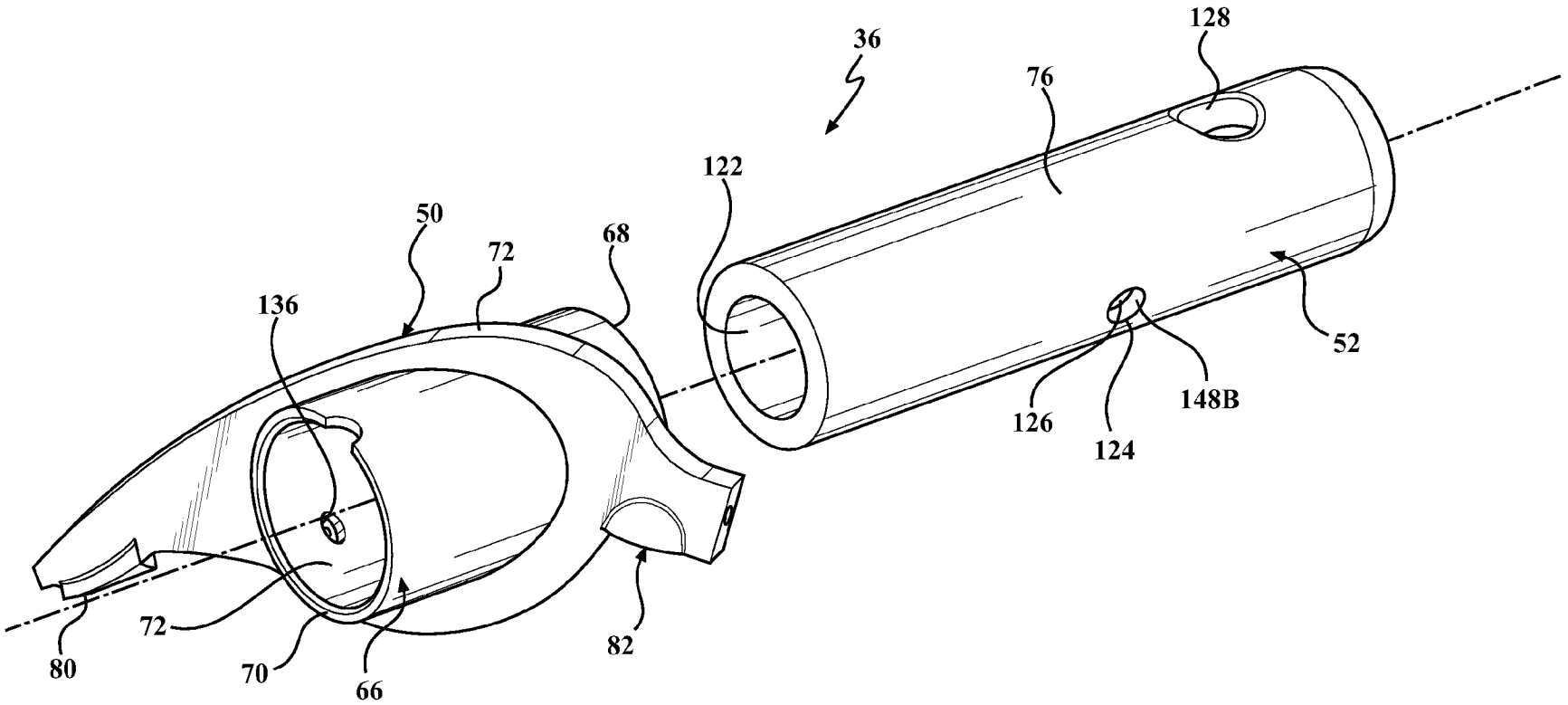
FIG. 17 is an exploded partial perspective view of the rocker arm assembly of FIG. 16 and another embodiment of the shaft of FIG. 14.

Referring now to FIGS. 3 and 12, as noted above, the valvetrain assembly 36 is lubricated by the oil pump 44 of the lubrication system 40 of the engine 20, whereby oil is typically translated between the oil pump 44, rocker arm assembly 50, intermediate member 48, and valve 38. More specifically, the inner surface 72 of the tube member 64 of the rocker arm assembly 50 is in fluid communication with the oil pump 44 so as to ensure smooth, consistent rotation of the rocker arm assembly 50 about the shaft 52, as described above. To that end, the shaft 52 includes an inner channel 122, a feed port 124, and a feed channel 126. The inner channel 122 is spaced from the outer bearing surface 76 and is in fluid communication with the oil pump 44 of the engine 20, typically via securing holes 128 in fluid communication with the oil pump 44 that are also used to attach the shaft 52 to the cylinder head 24 (see FIGS. 13, 14, and 17). The feed port 124 is defined in the outer bearing surface 76 of the shaft 52, and the feed channel 126 extends between the feed port 124 and the inner channel 122, thereby providing oil to the inner surface 72 of the tube member 64 of the rocker arm assembly 50.

Referring now to FIGS. 8, 9, and 12, as noted above, the rocker arm assembly 50 translates oil to the intermediate member 48 via the socket 82. To that end, the rocker arm assembly 50 includes a socket port 130 defined in the inner surface 72 of the tube member 64, and a socket channel 132 extending from the socket port 130 to the socket 82. More specifically, the socket channel 132 extends from the socket port 130 to the receiving cup 118 of the socket 82. Similarly, in one embodiment, the rocker arm assembly 50 includes a sprayer 134 disposed in the arm 66 adjacent to the pad 80. The sprayer 134 acts as a nozzle to direct oil to the valve 38. To that end, the rocker arm assembly 50 includes a spray port 136 defined in the inner surface 72 of the tube member 64, and a spray channel 138 extending from the spray port 136 to the sprayer 134. As shown best in FIG. 12, the spray port 136 is spaced from the socket port 130. Similarly, the socket channel 132 is spaced from the spray channel 138.

Figure 15A:
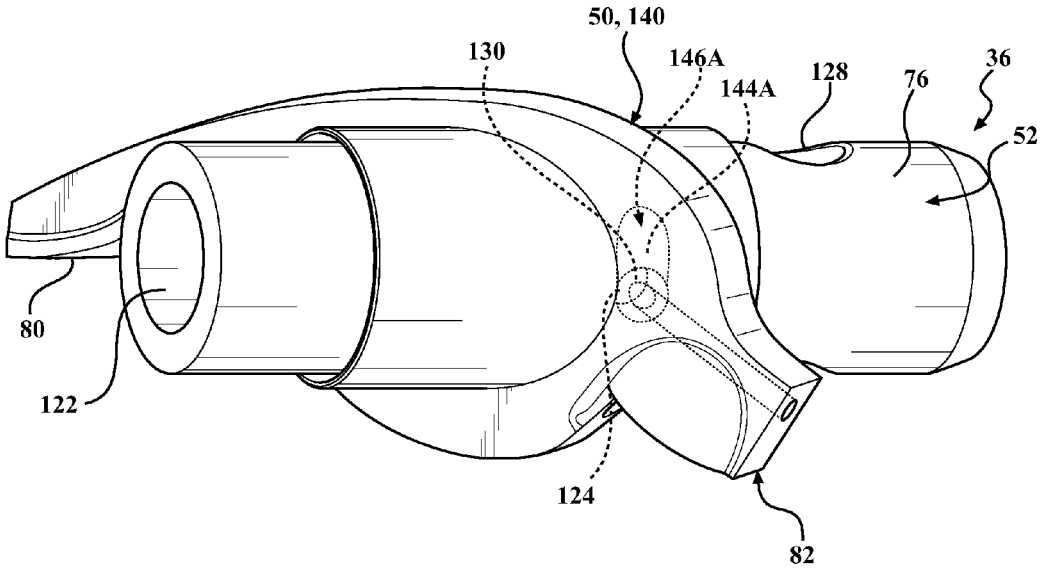
FIG. 15A is a partial perspective view of one embodiment of the rocker arm assembly, shown with hidden lines visible, and shaft of FIG. 14 in a first configuration.
Figure 18A:
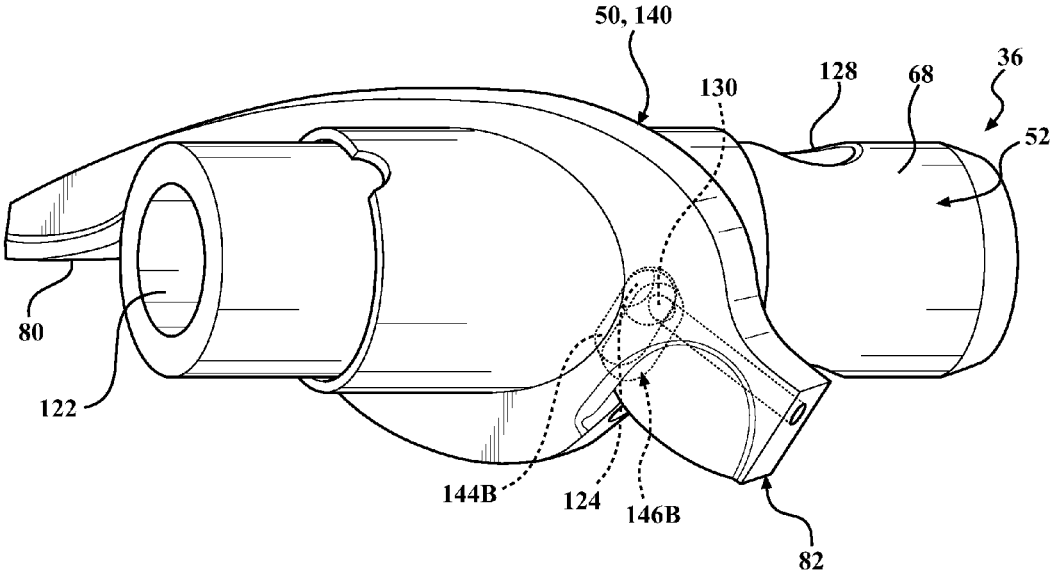
FIG. 18A is a partial perspective view of one embodiment of the rocker arm assembly of FIGS. 16-17, shown with hidden lines visible, and shaft of FIG. 17 in a first configuration.
Figure 18B:
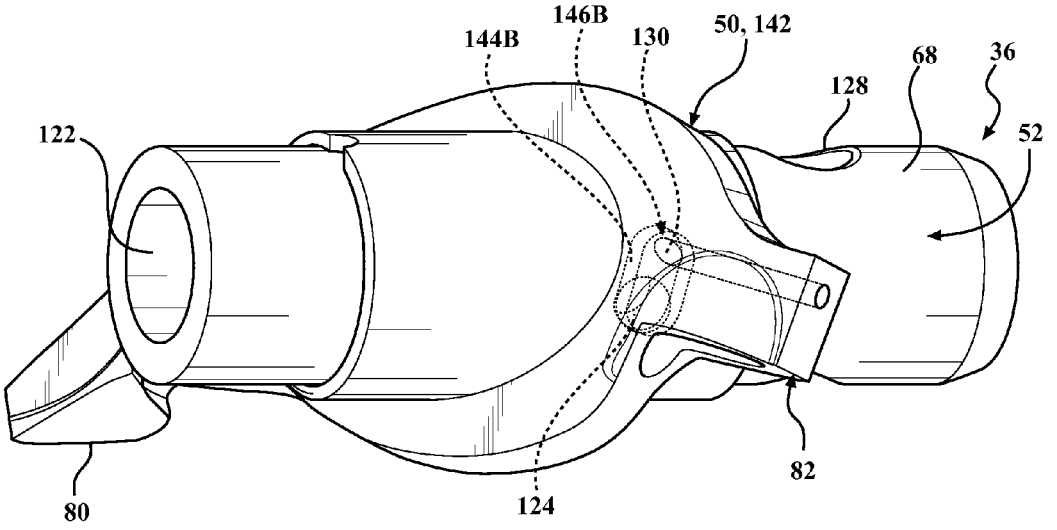
FIG. 18B is an alternate partial perspective view of the rocker arm assembly and shaft of FIG. 18A in a second configuration.

As noted above, the valvetrain assembly 36 of the present invention is used to translate lubricating oil from the oil pump 44 to the intermediate member 48 and valve 38. Those having ordinary skill in the art will appreciate that certain types of engines 20 are configured such that the rocker arm assembly 50 of the valvetrain assembly 36 does not lubricate the intermediate member 48, or only lubricates the pivoting connection 112 adjacent to the ball end 110 of the pushrod 60. However, in engines 20 configured such that the intermediate member 48 is lubricated by the rocker arm assembly 50, and in particular where the intermediate member 48 is defined as a pushrod 60 and hydraulic lash adjuster 58 lubricated via the pushrod 60, lubrication can be problematic in operation. FIG. 13 depicts such an oil flow configuration. Because the socket port 130 of the rocker arm assembly 50 is defined in a specific location along the inner surface 72 of the rocker arm assembly 50, and because the rocker arm assembly 50 moves in operation, oil flow to the intermediate member 48 can be interrupted in operation, leading to increased noise generation and wear and a decrease in engine 20 performance. More specifically, the rocker arm assembly 50 is rotatable about the shaft 52 between a valve closed position 140 (see FIGS. 15A and 18A) and a valve open position 142 (see FIGS. 15B and 18B). When the rocker arm assembly 50 is in the valve closed position 140, the socket port 130 of the rocker arm assembly 50 is substantially aligned with the feed port 124 of the shaft 52. When the rocker arm assembly 50 is in the valve open position 142, the socket port 130 of the rocker arm assembly 50 is spaced from the feed port 124 of the shaft 52.

Figure 14:
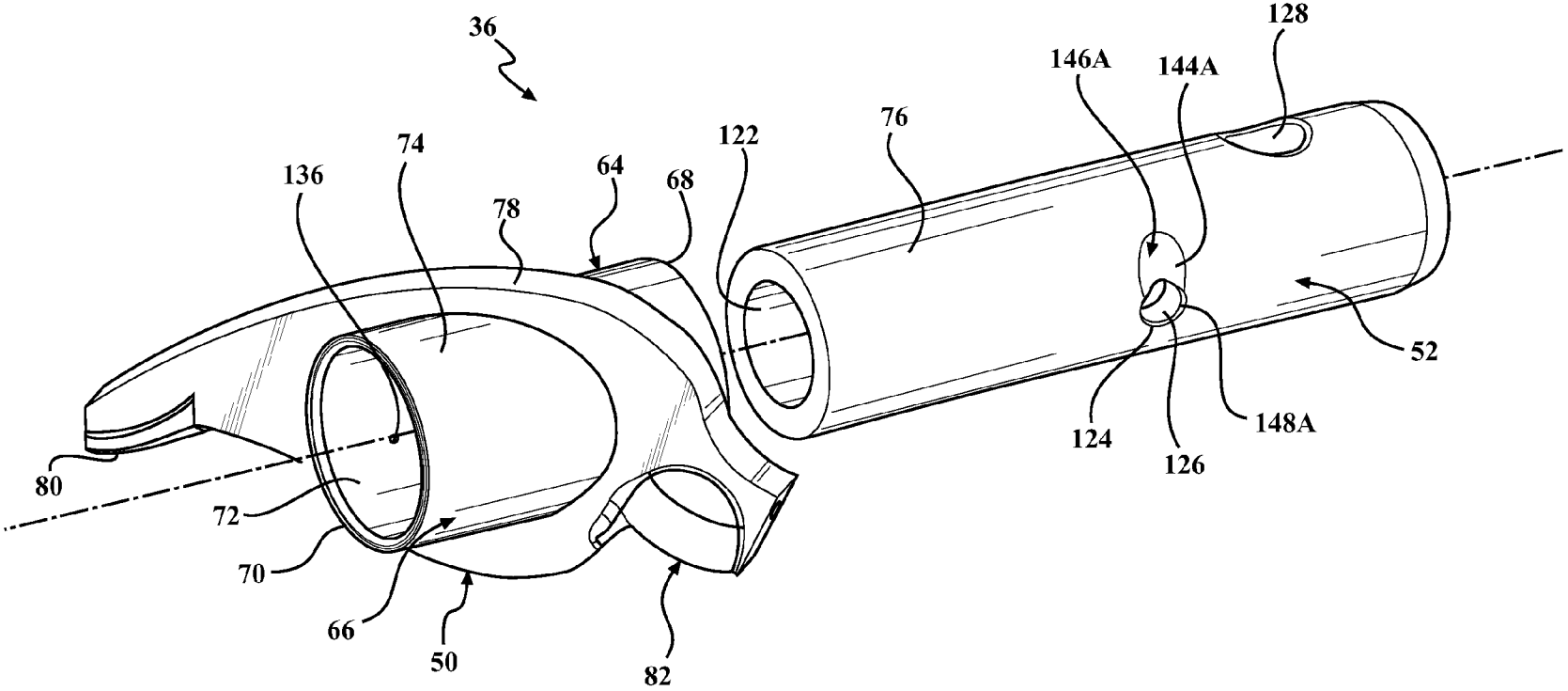
FIG. 14 is an exploded partial perspective view of the rocker arm assembly and shaft of FIGS. 2 and 12, according to one embodiment of the present invention.
Figure 15B:
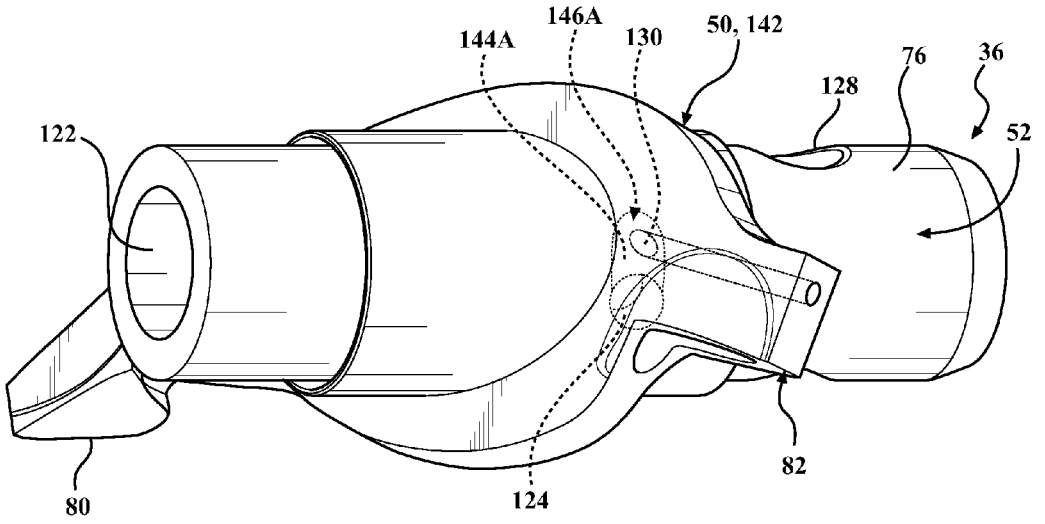
FIG. 15B is an alternate partial perspective view of the rocker arm assembly and shaft of FIG. 15A in a second configuration.
Figure 16:
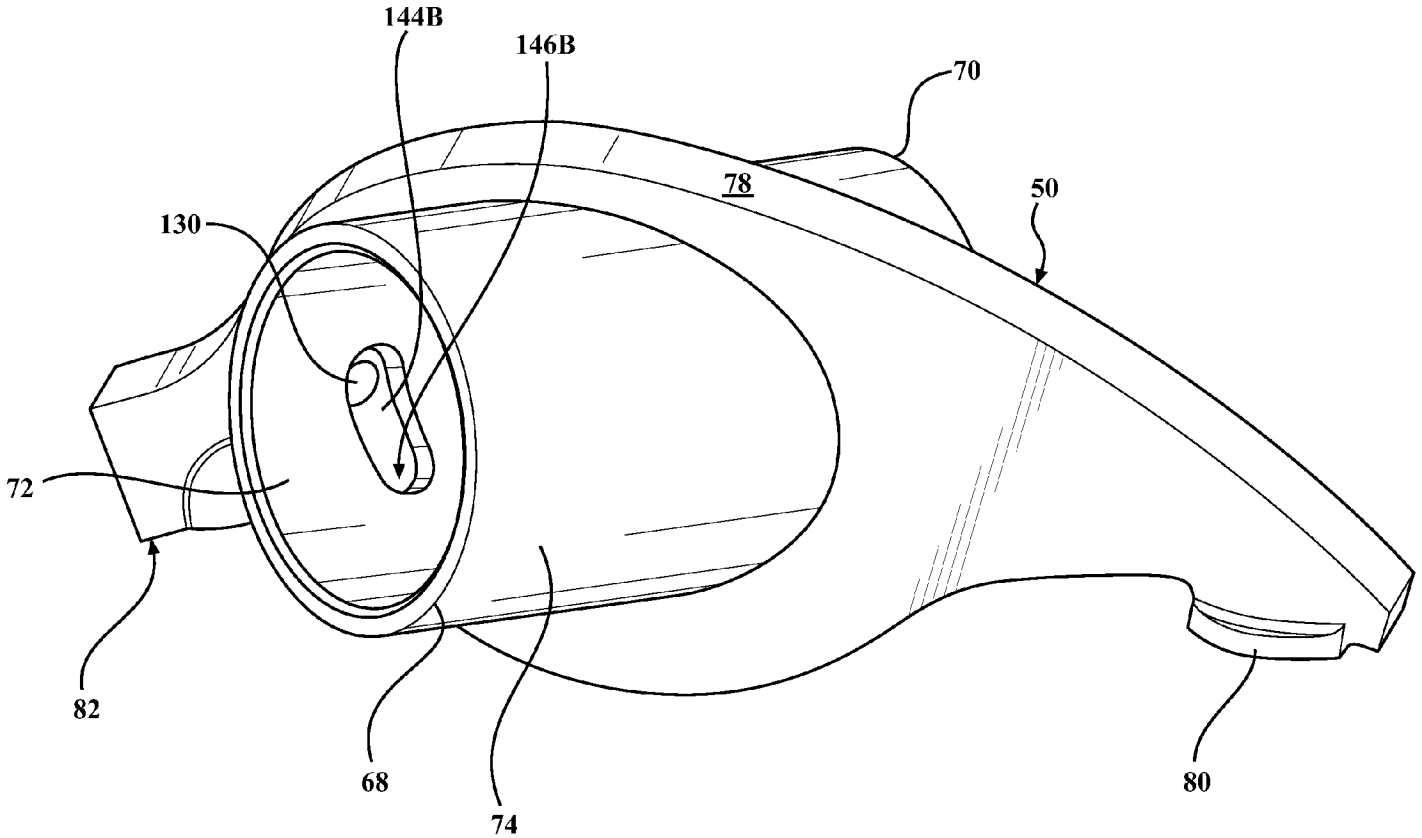
FIG. 16 is an enlarged perspective view of another embodiment of the rocker arm assembly of FIG. 4.

Referring now to FIGS. 14-15B, according to one embodiment of the present invention, the shaft 52 includes a recess 144A disposed in the outer bearing surface 76 adjacent to the feed port 124. The recess 144A has an elongated profile extending from the feed port 124 to a base 146A. The base 146A is substantially aligned with the socket port 130 of the rocker arm assembly 50 when the rocker arm assembly 50 rotates to the valve open position 142, thereby ensuring proper oil flow to the intermediate member 48 during engine 20 operation, particularly while the valve 38 is open. In one embodiment, the base 146A is spaced from the socket port 130 of the rocker arm assembly 50 when the rocker arm assembly 50 rotates to the valve closed position 140. However, it will be appreciated that the base 146A could be configured in any suitable way sufficient to be substantially aligned with the socket port 130 of the rocker arm assembly 50 when the rocker arm assembly 50 rotates to the valve open position 142, without departing from the scope of the present invention. Further, as shown best in FIG. 14, the base 146A of the recess 144A is spaced from the inner channel 122 of the shaft 52. However, it will be appreciated that the base 146A could extend to the inner channel 122 without departing from the scope of the present invention. In one embodiment, the feed port 124 of the shaft 52 includes a chamfer portion 148A that merges the feed channel 126 with the recess 144A and the outer bearing surface 72.

Referring now to FIGS. 16-18B, in another embodiment of the present invention, the shaft 52 and the rocker arm assembly 50 are configured differently than described above, wherein the rocker arm assembly 50 includes a recess 144B disposed in the inner surface 72 adjacent to the socket port 130 (compare FIGS. 15A and 15B to FIGS. 18A and 18B). The recess 144B has an elongated profile extending from the socket port 130 to a base 146B. The base 146B is substantially aligned with the feed port 124 of the shaft 42 when the rocker arm assembly 50 rotates to the valve open position 142, thereby ensuring proper oil flow to the intermediate member 48 during engine 20 operation, particularly while the valve 38 is open. In one embodiment, the base 146B is spaced from the feed port 124 of the shaft 52 when the rocker arm assembly 50 rotates to the valve closed position 140. However, it will be appreciated that the base 146B could be configured in any suitable way sufficient to be substantially aligned with the feed port 124 of the shaft 52 when the rocker arm assembly 50 rotates to the valve open position 142, without departing from the scope of the present invention. Further, as shown best in FIG. 16, the base 146B of the recess 144B is spaced from the inner surface 72 of the rocker arm assembly 50. In one embodiment, the feed port 124 of the shaft 52 includes a chamfer portion 148B that merges the feed channel 126 the outer bearing surface 72.

In this way, the valvetrain assembly 36 of the present invention significantly reduces the complexity, cost, and packaging size of rocker arm assemblies 50 and associated components. Specifically, it will be appreciated that the present invention allows rocker arm assemblies 50 to translate oil to intermediate members 38 during all stages of engine 20 operation, thereby reducing rotating friction and noise generation and, at the same time, increasing engine 20 efficiency, performance, and response. Moreover, the present invention reduces the cost of manufacturing valvetrain assemblies 36 that have superior operational characteristics, such as improved performance, component life and longevity, efficiency, weight, load and stress capability, and packaging orientation.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A valvetrain assembly for translating force between an intermediate member in communication with a camshaft of an internal combustion engine and a valve supported in a cylinder head of the engine, and for translating lubrication from an oil pump of the engine to the intermediate member and the valve of the engine, said valvetrain assembly comprising:

at least one rocker arm assembly having a substantially cylindrical inner surface, a pad spaced from said inner surface for engaging the valve of the engine, a socket spaced from said pad for engaging the intermediate member of the engine, a socket port defined in said inner surface, and a socket channel extending from said socket port to said socket;

at least one elongated shaft having an outer bearing surface for supporting said inner surface of said rocker arm assembly, an inner channel spaced from said outer bearing surface and in fluid communication with the oil pump of the engine, a feed port defined in said outer bearing surface, and a feed channel extending from said feed port to said inner channel;

wherein said rocker arm assembly is rotatable about said shaft between:

a valve closed position, wherein said socket port of said rocker arm assembly is substantially aligned with said feed port of said shaft, and a valve open position, wherein said socket port of said rocker arm assembly is spaced from said feed port of said shaft;

said valvetrain assembly further including a recess disposed in said outer bearing surface of said shaft adjacent to said feed port, said recess having an elongated profile extending from said feed port to a base, said base being substantially aligned with said socket port of said rocker arm assembly when said rocker arm assembly rotates to said valve open position.

2. The valvetrain assembly as set forth in claim 1, wherein said base is spaced from said socket port of said rocker arm assembly when said rocker arm assembly rotates to said valve closed position.

3. The valvetrain assembly as set forth in claim 1, wherein said base of said recess is spaced from said inner channel of said shaft.

4. The valvetrain assembly as set forth in claim 1, wherein said feed port of said shaft includes a chamfer portion, said chamfer portion merging said feed channel with said recess and said outer bearing surface.

5. The valvetrain assembly as set forth in claim 1, wherein said shaft is operatively attached to the cylinder head of the engine.

6. A valvetrain assembly for translating force between an intermediate member in communication with a camshaft of an internal combustion engine and a valve supported in a cylinder head of the engine, and for translating lubrication from an oil pump of the engine to the intermediate member and the valve of the engine, said valvetrain assembly comprising:

at least one rocker arm assembly having a substantially cylindrical inner surface, a pad spaced from said inner surface for engaging the valve of the engine, a socket spaced from said pad for engaging the intermediate member of the engine, a socket port defined in said inner surface, and an socket channel extending from said socket port to said socket;

at least one elongated shaft having an outer bearing surface for supporting said inner surface of said rocker arm assembly, an inner channel spaced from said outer bearing surface and in fluid communication with the oil pump of the engine, a feed port defined in said outer bearing surface, and a feed channel extending from said feed port to said inner channel;

wherein said rocker arm assembly is rotatable about said shaft between:

a valve closed position, wherein said socket port of said rocker arm assembly is substantially aligned with said feed port of said shaft, and a valve open position, wherein said socket port of said rocker arm assembly is spaced from said feed port of said shaft;

said valvetrain assembly further including a recess disposed in said inner surface of said rocker arm assembly adjacent to said socket port, said recess having an elongated profile extending from said socket port to a base, said base being substantially aligned with said feed port of said shaft when said rocker arm assembly rotates to said valve open position.

7. The valvetrain assembly as set forth in claim 6, wherein said base is spaced from said feed port of said shaft when said rocker arm assembly rotates to said valve closed position.

8. The valvetrain assembly as set forth in claim 6, wherein said base of said recess is spaced from said inner surface of said rocker arm assembly.

9. The valvetrain assembly as set forth in claim 6, wherein said feed port of said shaft includes a chamfer portion, said chamfer portion merging said feed channel with said outer bearing surface.

10. The valvetrain assembly as set forth in claim 6, wherein said shaft is operatively attached to the cylinder head of the engine.

* * * * *